US010227536B2

(12) United States Patent
Thakkar

(10) Patent No.: US 10,227,536 B2
(45) Date of Patent: Mar. 12, 2019

(54) METHODS FOR ALTERNATING PRODUCTION OF DISTILLATE FUELS AND LUBE BASESTOCKS FROM HEAVY HYDROCARBON FEED

(71) Applicant: UOP LLC, Des Plaines, IL (US)

(72) Inventor: Vasant P. Thakkar, Elk Grove, IL (US)

(73) Assignee: UOP LLC, Des Plaines, IL (US)

( * ) Notice: Subject to any disclaimer, the term of this patent is extended or adjusted under 35 U.S.C. 154(b) by 1136 days.

(21) Appl. No.: 14/557,215

(22) Filed: Dec. 1, 2014

(65) Prior Publication Data

US 2016/0152913 A1 Jun. 2, 2016

(51) Int. Cl.
*C10G 65/12* (2006.01)
*C10G 65/04* (2006.01)

(52) U.S. Cl.
CPC ..... *C10G 65/12* (2013.01); *C10G 65/043* (2013.01); *C10G 2400/02* (2013.01); *C10G 2400/04* (2013.01); *C10G 2400/10* (2013.01)

(58) Field of Classification Search
CPC ..... C10G 2400/02; C10G 2400/04; C10G 2400/10; C10G 65/043; C10G 65/12; C10G 56/00; C10G 45/10; C10G 45/58; C10G 45/72
See application file for complete search history.

(56) References Cited

U.S. PATENT DOCUMENTS

| | | | |
|---|---|---|---|
| 4,851,109 | A | 7/1989 | Chen et al. |
| 6,569,313 | B1 | 5/2003 | Carroll et al. |
| 7,250,106 | B2 | 7/2007 | Benazzi et al. |
| 8,231,778 | B2 | 7/2012 | Gala |
| 8,394,255 | B2 | 3/2013 | McCarthy et al. |
| 8,617,383 | B2 | 12/2013 | Prentice et al. |
| 2005/0183988 | A1 | 8/2005 | Freerks et al. |
| 2009/0050524 | A1 | 2/2009 | Kim et al. |
| 2013/0066122 | A1 | 3/2013 | Joseck et al. |
| 2013/0264246 | A1 | 10/2013 | Holtzer et al. |

FOREIGN PATENT DOCUMENTS

| | | | | |
|---|---|---|---|---|
| EP | 0863963 A1 | | 9/1998 | |
| EP | 0883664 A1 | | 12/1998 | |
| EP | 0793700 B1 | | 2/2002 | |
| WO | WO 01/57158 | * | 8/2001 | ..... C10G 45/58 |
| WO | 2002038702 A1 | | 5/2002 | |
| WO | 2012005980 A2 | | 12/2012 | |

OTHER PUBLICATIONS

Halle, et al. Hydrogen Optimisation at minimal investment, 2003, PTQ, Spring, p. 83-90.*
Search Report dated Mar. 17, 2016 for corresponding PCT International Application No. PCT/US2015/062611.
Hong et al., Technologies of Producing API II and III Lube Base Oils from Hydrocracking Unconverted Oils, Petroleum Refinery Engineering, v 42, n 10, p. 9-13, Oct. 15, 2012.

* cited by examiner

*Primary Examiner* — Renee Robinson
*Assistant Examiner* — Derek N Mueller
(74) *Attorney, Agent, or Firm* — Paschall & Maas Law Office; James Paschall

(57) ABSTRACT

Methods and apparatus are provided for converting heavy hydrocarbons to middle distillate fuels and, alternately, to Group II and III lube oils, in the presence of suitable metal catalysts using the same refining system with minor adjustments required to change between operating in fuel mode and operating in lube mode.

18 Claims, 1 Drawing Sheet

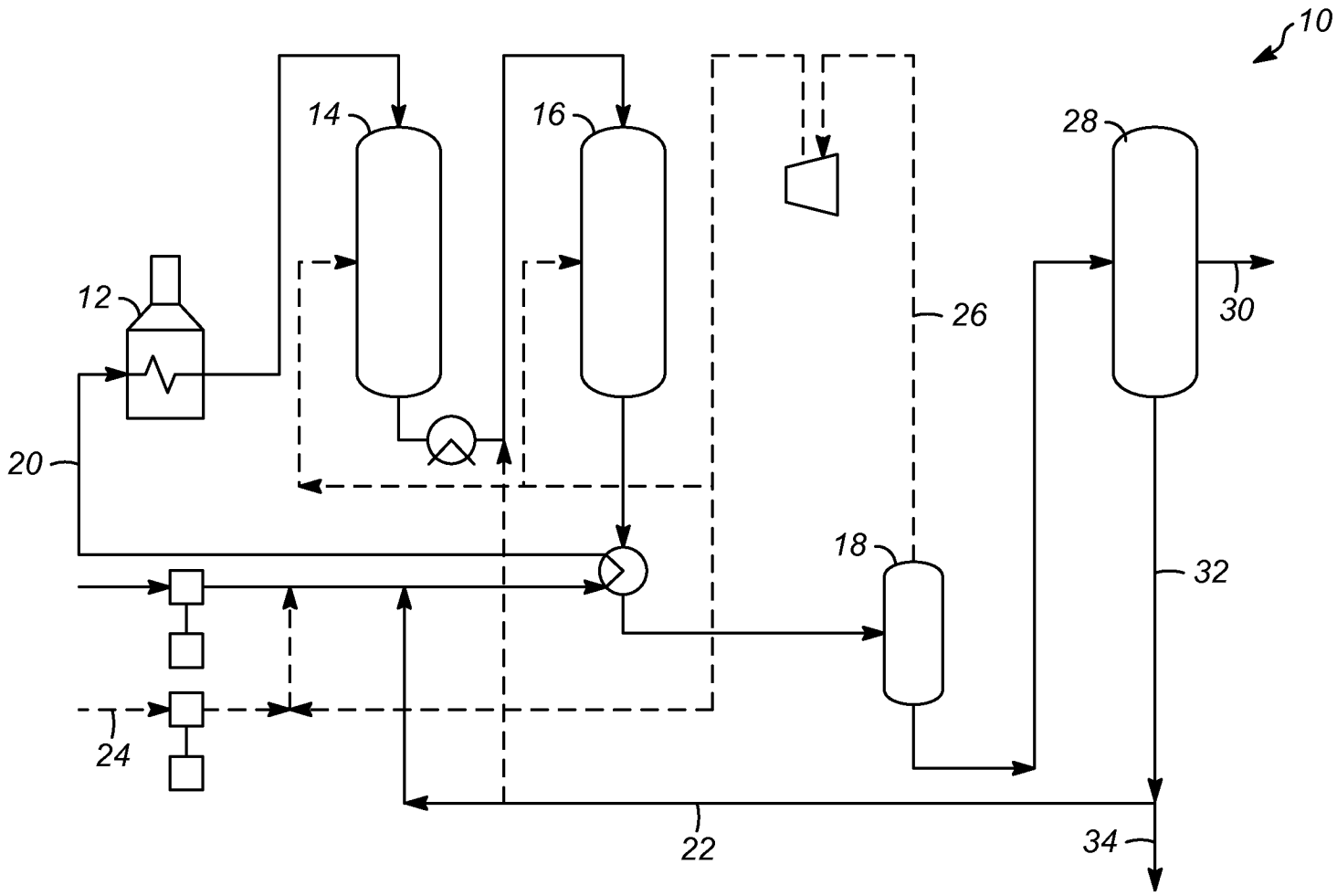
10
30
28
32
34
26
18
22
16
14
12
20
24

METHODS FOR ALTERNATING PRODUCTION OF DISTILLATE FUELS AND LUBE BASESTOCKS FROM HEAVY HYDROCARBON FEED

TECHNICAL FIELD

The disclosure generally relates to methods and systems for processing hydrocarbon feed and more particularly relates to methods and systems for alternately converting heavy hydrocarbon feed to middle distillate fuels and Group II and III lube basestocks.

BACKGROUND

Crude oil contains a broad mixture of different sizes and types of hydrocarbons, such as $C_2$-$C_{50}$ hydrocarbons, or even higher. Different classes of hydrocarbons are suitable for making different end products with different uses. Accordingly, crude oil is typically first refined by atmospheric distillation to produce portions or "fractions" of hydrocarbons including light distillates, middle distillates, and heavy distillates and residuals. Each fraction contains a mixture of hydrocarbons having a narrower range of properties than the original crude oil mixture. The operating conditions under which atmospheric distillation is performed can shift the quantity and particular property ranges of each fraction that is produced. Due to this variability, there is some overlap of the property ranges among the various fractions.

For example, the light distillate fraction includes primarily $C_2$-$C_{10}$ hydrocarbons, which are useful for making products such as liquid petroleum gas (LPG), gasoline, and naphtha. Middle distillates include primarily $C_8$-$C_{23}$ hydrocarbons, which are the mid-sized hydrocarbon molecules from the original crude oil and are useful, for example, as kerosene, diesel fuel, jet fuel, and light fuel oil. The heavy distillate fraction and residual products derived from atmospheric distillation of crude oil include primarily $C_{18}$ and higher hydrocarbons, which are useful, for example, as heavy fuel oil (HFO), lubricating oils, wax and asphalt. It is understood that each distillate fraction may, in fact, contain very small amounts of hydrocarbons outside the aforesaid ranges, without altering the general characteristics of the distillate fractions.

Further refining and processing of the various atmospheric distillation fractions is often performed to produce fractions having even narrower characteristics. For instance, light fuels such as kerosene, diesel fuels, and heavier distillate fuels may be obtained by further fractionation of the middle distillate fraction. Additionally, the heavy distillate and residual fraction is often further separated into heavy fuel oils, lubricating (lube) oils, waxes and asphalt (bitumen) products. Such separation is often accomplished, for example, by vacuum distillation which in addition to producing the aforesaid products from the heaviest atmospheric distillation fraction, also produces vacuum gas oil (VGO). In turn, hydrocracking of VGO converts these relatively heavy hydrocarbons to mid-range and light hydrocarbons, with a portion of the heavy hydrocarbons leaving the hydrocracker as unconverted oil (UCO). VGO and UCO are commonly further refined and processed, e.g., using hydrocracking, hydrotreating, and separation methods, to produce various products including some distillate fuels and high quality lube basestocks.

Both distillate fuel oils and high quality lube basestocks can be, and are routinely, manufactured from the same or similar classes of heavy hydrocarbons, including VGO and UCO. However, different operating conditions and different catalyst compositions are typically employed to make these two different petroleum products, which generally means that separate process apparatus is used to produce them.

Accordingly, it is desirable to provide methods and systems that enable production of one or the other product, alternately, using the same refining system with minimal adjustments between operational modes (i.e., fuel mode or lube mode). Other desirable features and characteristics of the methods and systems described herein will become apparent from the subsequent detailed description and the appended claims, taken in conjunction with the accompanying drawings.

BRIEF SUMMARY

Methods and systems are provided for processing heavy hydrocarbons to alternately produce distillate fuels and lube basestocks. In an exemplary embodiment, a method is provided for processing heavy hydrocarbons, the method comprising the steps of: providing a refining system comprising a dewaxing zone comprising a hydroisomerization catalyst and a hydrofinishing zone comprising a noble metal catalyst on an acidic support; providing heavy hydrocarbons comprising up to about 100 parts per million (ppm) of sulfur and up to about 10 ppm of nitrogen to the refining system; operating the refining system, for a first period of time, in either a fuel mode or a lube mode while contacting the heavy hydrocarbons with the hydroisomerization catalyst in the dewaxing zone and the noble metal catalyst on an acidic support in the hydrofinishing zone; operating the refining system, for a second period of time, in the other of the fuel mode or lube mode while contacting the heavy hydrocarbons with the hydroisomerization catalyst in the dewaxing zone and the noble metal catalyst on an acidic support in the and hydrofinishing zone; and producing a middle distillate fuel oil fraction comprising distillate fuels when the refining system is operating in the fuel mode and producing a lube oil fraction comprising lube basestocks when the refining system is operating in the lube mode.

Another exemplary embodiment provides a method for processing heavy hydrocarbons, said method comprising the steps of: providing a refining system comprising a dewaxing zone comprising a hydroisomerization catalyst and a hydrofinishing zone comprising a noble metal catalyst on an acidic support; providing heavy hydrocarbons comprising up to about 100 parts per million (ppm) of sulfur and up to about 10 ppm of nitrogen to the refining system; operating the refining system, for a first period of time, in either a fuel mode or a lube mode while contacting the heavy hydrocarbons with the hydroisomerization catalyst in the dewaxing zone and the noble metal catalyst on an acidic support in the hydrofinishing zone; operating the refining system, for a second period of time, in the other of the fuel mode or lube mode while contacting the heavy hydrocarbons with the hydroisomerization catalyst in the dewaxing zone and noble metal catalyst on an acidic support in the hydrofinishing zone; and producing a middle distillate fuel oil fraction comprising distillate fuels when the refining system is operating in the fuel mode and producing a lube oil fraction comprising lube basestocks when the refining system is operating in the lube mode. In this embodiment of the method, operating the refining system in fuel mode comprises: contacting the heavy hydrocarbons with the hydroisomerization catalyst in the dewaxing zone of the refining system at temperatures of from about 230 to about 427° C.

and pressures of from about 3.45 to about 17.24 MPa, whereby dewaxed hydrocarbons are produced; contacting the dewaxed hydrocarbons with the noble metal catalyst on an acidic support in the hydrofinishing zone of the refining system, the hydrofinishing zone being in fluid contact with the dewaxing zone, at temperatures of from greater than about 288 to about 427° C. (greater than about 550 to about 800° F.) and a pressure of from about 3.45 to about 17.24 MPa, whereby fuel mode refined hydrocarbons are produced; and fractionating the fuel mode refined hydrocarbons in a fractionation region of the refining system, the fractionating region being in fluid communication with the hydrofinishing zone, to produce a middle distillate fuel oil fraction comprising distillate fuels. Furthermore, in this embodiment of the method, operating the refining system in lube mode comprises: contacting the heavy hydrocarbons with the hydroisomerization catalyst in the dewaxing zone of the refining system at temperatures of from about 230 to about 427° C. and pressures of from about 3.45 to about 17.24 megaPascals (MPa), whereby dewaxed heavy hydrocarbons are produced; contacting the dewaxed heavy hydrocarbons with the noble metal catalyst on an acidic support in the hydrofinishing zone of the refining system at temperatures of from about 200 to about 288° C. (about 392 to about 550° F.) and a pressure of from about 3.45 to about 17.24 MPa, whereby lube mode refined hydrocarbons are produced; and fractionating the lube mode refined hydrocarbons in the fractionation region of the refining system to produce a lube oil fraction comprising lube basestocks.

In still another embodiment, a refining system is provided which comprises: a dewaxing zone comprising a hydroisomerization catalyst capable of catalyzing hydroisomerization of heavy hydrocarbons; a hydrofinishing zone comprising a noble metal catalyst on an acidic support capable of catalyzing saturation of heavy hydrocarbons, the hydrofinishing zone being in fluid communication with the dewaxing zone; and a fractionation region in fluid communication with the hydrofinishing zone configured for fractionating products of the dewaxing and hydrofinishing zones, wherein the refining system is configured for alternately producing middle distillate fuels and lube oil base stocks from heavy hydrocarbons.

BRIEF DESCRIPTION OF THE DRAWINGS

The various embodiments will hereinafter be described in conjunction with the following drawing, wherein:

FIG. 1 is a schematic process diagram showing a refining system suitable for practicing a method in accordance with an exemplary embodiment.

DETAILED DESCRIPTION

The following detailed description is merely exemplary in nature and is not intended to limit the scope of the methods and systems contemplated and described herein or their application and uses. Furthermore, there is no intention to be bound by any theory presented in the preceding background or the following detailed description.

In an exemplary embodiment, methods and systems are provided for alternating production of middle distillate fuels ("fuel oils") and lube basestocks from heavy hydrocarbons. More particularly, such a method comprises the steps of providing a refining system that comprises a dewaxing zone comprising a hydroisomerization catalyst and a hydrofinishing zone comprising a noble metal catalyst on an acidic support; and providing heavy hydrocarbons comprising up to about 100 parts per million (ppm) of sulfur and up to about 10 ppm of nitrogen to the dewaxing zone of the refining system. The method contemplated and described herein further comprises the steps of: operating the refining system, for a first period of time, in either a fuel mode or a lube mode while contacting the heavy hydrocarbons with the hydroisomerization catalyst and the noble metal catalyst on an acidic support in each of the dewaxing and hydrofinishing zones, respectively; and, alternately, operating the refining system, for a second period of time, in the other of the fuel mode or lube mode while contacting the heavy hydrocarbons with the hydroisomerization catalyst and the noble metal catalyst on an acidic support in each of the dewaxing and hydrofinishing zones, respectively. This method further comprises producing a middle distillate fuel oil fraction comprising distillate fuels when the refining system is operating in the fuel mode and producing a lube oil fraction comprising lube basestocks when the refining system is operating in the lube mode. More particularly, when the refining system is operated in the fuel mode, at least 80 weight percent (wt %) of the total refined hydrocarbons produced comprise distillate fuels having a boiling point of less than about 371° C. (about 700° F.). Alternatively, when the refining system is operated in lube mode, at least 70 wt % of the total refined hydrocarbons produced comprise the lube oil fraction comprising lube basestocks having a boiling point of at least about 371° C. (about 700° F.)

Heavy hydrocarbons suitable for conversion to distillate fuel and lube basestocks by the methods and systems contemplated and described herein comprise primarily $C_{20}$-$C_{50}$ hydrocarbons and have a boiling point range above that of diesel fuel, i.e., above about 343° C. (about 650° F.), and comprise up to about 100 parts per million (ppm) of sulfur and up to about 10 ppm of nitrogen. Such low sulfur and nitrogen content heavy hydrocarbons are available, for example, as heavy hydrocarbon fractions produced by atmospheric and/or vacuum distillation of crude oil that have been further subjected to hydrotreating processes, as mentioned above to remove organic sulfur and nitrogen from petroleum-derived heavy hydrocarbon fractions. As used herein, the phrase hydrocarbons containing or comprising "primarily" a specified range of carbon-numbered hydrocarbons and a boiling temperature within a specified range of temperatures means that the group or fraction of hydrocarbons being described may also contain very small amounts of hydrocarbons outside the stated carbon number range, without altering the general characteristics (e.g., boiling point) of the group or fraction being described. For example, the description that middle distillates comprise primarily $C_8$-$C_{23}$ hydrocarbons means that middle distillates contain at least 80 weight percent of hydrocarbon molecules each having from about 8 to about 23 carbon atoms with, possibly, very small amounts of hydrocarbon molecules each having less than about 8 carbon atoms, as well as very small amounts of hydrocarbon molecules each having more than 23 carbon atoms, such that the boiling point remains in the range of from about 149 to about 371° C. (about 300 to about 700° F.).

The heavy distillate and residual fraction derived from atmospheric distillation of crude oil contains the heaviest hydrocarbons from the crude oil and may be separated to form products including heavy fuel oil, lubricating (lube) oils, waxes and asphalt (bitumen). When the heavy distillate and residual fraction is subjected to vacuum distillation, for example, various heavy hydrocarbon-containing products are obtained, including vacuum gas oil (VGO) which comprises primarily $C_{20}$-$C_{50}$ hydrocarbons and has a boiling point of from about 343 to about 566° C. (about 650 to about 1050° F.). In turn, hydrocracking of VGO converts these relatively heavy hydrocarbons to mid-range and light hydrocarbons, but a portion of the heavy hydrocarbons in the VGO remain as unconverted oil (UCO). More particularly, VGO is typically first subjected to hydrotreating to remove sulfur, nitrogen, oxygen and metals, leaving a hydrotreated VGO. Then, the hydrotreated VGO is subjected to a hydrocracking (HDC) process which converts a major portion of the VGO hydrocarbons to lighter hydrocarbons. The hydrocracked hydrocarbons product is passed through a series of fractionators to separate and produce various light oil products, as well as left over UCO which contains the heaviest hydrocarbons remaining after the HDC process. VGO and UCO are commonly further refined and processed, e.g., using hydrocracking, hydrotreating, and separation methods, to produce various products including some distillate fuel oils and high quality lube basestocks.

As already discussed, if heavy hydrocarbons contain sulfur above 100 parts per million (ppm), they must first be subjected to a sulfur removal process, such as hydrotreating, to form low sulfur and nitrogen content heavy hydrocarbons for providing to the dewaxing zone of the refining system. Similarly, if the heavy hydrocarbons contain nitrogen above 10 parts per million (ppm), they must first be subjected to a nitrogen removal process, which may be the same or different from the hydrotreating process which removes sulfur, to form low sulfur and nitrogen content heavy hydrocarbons for providing to the dewaxing zone of the refining system. Advantageously, the hydrotreating process may be performed under conditions that are familiar and known to persons of ordinary skill in the relevant art to remove both sulfur and nitrogen from the heavy hydrocarbons. As known to persons of ordinary skill, hydrotreating may be performed separate and independently of other processes during refining of hydrocarbons, or it may be performed concurrently with other refining processes such as hydrocracking or other process. Also as known to persons of ordinary skill, hydrotreating is typically performed in the presence of one or more hydrotreating catalysts.

Thus, the low sulfur and nitrogen content heavy hydrocarbons suitable for use in the methods and systems contemplated and disclosed herein, may be derived from various sources of heavy hydrocarbons, including gas oils, such as vacuum gas oil (VGO), that boil in representative ranges, for example, from about 288° C. (550° F.) to about 593° C. (1100° F.), and often from about 343° C. (650° F.) to about 566° C. (1050° F.). In addition to, or other than, VGO, particular fresh feed components also include a wide variety of straight run and converted heavy hydrocarbon fractions obtained in refinery operations (i.e., derived from crude oil), such as atmospheric gas oils, vacuum residuals and deasphalted vacuum residuals (e.g., boiling above 566° C. (1050° F.)), atmospheric residuals (e.g., boiling above about 343° C. (650° F.)), straight run distillates, whole or topped petroleum crude oils including heavy crude oils, high boiling synthetic oils, cycle oils and catalytic cracker (e.g., fluid catalytic cracking or FCC) distillates. Fresh feed components of petroleum-derived heavy hydrocarbons may also include mineral oils and synthetic oils (e.g., tars, bitumen, coal oils, shale oil, tar sand products, etc.) and fractions thereof.

Exemplary heavy hydrocarbons comprise a combination of VGO or a predominantly VGO (e.g., generally at least about 50%, and often at least about 75%, by weight VGO) fresh feed component and a recycled portion of the hydrocracker effluent. Regardless of the particular components that make up the heavy hydrocarbon feedstock, this stream generally comprises at least about 50%, and often at least about 75%, by weight of hydrocarbons boiling at temperatures above the initial boiling point of the desired lube base stock. The initial boiling point of the heavy hydrocarbon feedstock is generally at least about 288° C. (550° F.) and often at least about 343° C. (650° F.).

Returning to the method for alternately producing fuel oils and lube basestocks using a single refining system, the method comprises operating the refining system in either a fuel mode or a lube mode for a first period of time and operating the refining system for the other of the fuel mode or the lube mode for a second period of time. The first period of time and the second period of time should be, independently, at least about one week.

For example, without limitation, in some embodiments of the method, the refining system is operated in a fuel mode which favors production of fuel oils, for the first period of time, and then, the refining system is operated in a lube mode which favors production of lube basestock for the second period of time, which may be the same length or different from the first period of time. Likewise, in some embodiments of the method, the refining system is operated in a lube mode, which favors production of lube basestocks, for the first period of time, and then, the refining system is operated in a fuel mode, which favors production of fuel oils for the second period of time, which may be the same length or different from the first period of time.

More particularly, the fuel mode of operating the refining system favors production of fuel oils and comprises contacting the heavy hydrocarbons with the hydroisomerization catalyst in the dewaxing zone at temperatures of from about 200 to about 427° C. and pressures of from about 3.45 to about 17.24 MPa, to produce dewaxed heavy hydrocarbons. For example, the temperatures in the dewaxing zone during fuel mode operation may be, without limitation, from about 200 to about 400° C., or from about 200 to about 343° C., or even from about 200 to about 315° C. Likewise, the pressures in the dewaxing zone during fuel mode operation may be, for example without limitation, from about 3.45 to about 17.24 MPa, from about 3.45 to about 13.8 MPa, or even from about 3.45 to about 10.3 MPa. Although some cracking of the heavy hydrocarbons may occur in the presence of the hydroisomerization catalyst in the dewaxing zone, the objective of operating the dewaxing zone is to hydroisomerize n-alkanes contained in the heavy hydrocarbons to form iso-alkanes. Additionally, the dewaxing zone is operated to achieve up to about 30%, based on the total moles of heavy hydrocarbons provided to the dewaxing zone, conversion of the heavy hydrocarbons, such as for example, without limitation, up to about 20% conversion, or up to about 15% conversion, or even up to about 5% conversion of the heavy hydrocarbons. Under the aforesaid fuel mode operating conditions, hydroisomerization of the heavy hydrocarbons is catalyzed in the dewaxing zone, and dewaxed hydrocarbons are produced.

The hydroisomerization catalyst of the dewaxing zone is not particularly limited and may be any catalyst composition, known now or in the future, that is capable of catalyzing the hydroisomerization of heavy hydrocarbons wherein straight chain n-alkanes contained therein are converted to branched iso-alkanes. Suitable hydrosimoerizations catalysts, include, for example, without limitation, catalyst compositions containing at least one noble or non-noble metal from Group VIII, such as nickel, cobalt, platinum, and palladium, on refractory oxide or zeolite support structures made from silica-alumina, silica-alumina-phosphate, titania, zirconia, vanadia, Y sieves or ultrastable Y sieves. Other suitable hydroisomerization catalysts include, without limitation, supported or unsupported catalyst compositions containing platinum, fluoride and alumina. More particularly, in some embodiments, the hydroisomerization catalyst may include a non-noble Group VIII metal (e.g., cobalt) with a Group VI metal (e.g., molybdenum) on an acidic support structure. In still other embodiments, the hydroisomerization catalyst may be a noble Group VIII metal (e.g., platinum) on a zeolite support made from silica-alumina.

The fuel mode of operating the refining system further comprises contacting the dewaxed hydrocarbons with the noble metal catalyst on an acidic support in the hydrofinishing zone at temperatures of from greater than about 288 to about 427° C. (greater than about 550 to about 800° F.) and a pressure of from about 3.45 to about 17.24 MPa. For example, the temperatures in the hydrofinishing zone during fuel mode operation may be, without limitation, from about 290 to about 413° C., or from about 290 to about 400° C. Likewise, the pressures in the hydrofinishing zone during fuel mode operation may be, for example without limitation, from about 3.45 to about 17.24 MPa, from about 3.45 to about 13.8 MPa, or even from about 3.45 to about 10.3 MPa. Under the aforesaid fuel mode operating conditions, both saturation and cracking of heavy hydrocarbons in the dewaxed cracked hydrocarbons are catalyzed in the hydrofinishing zone, and fuel mode refined hydrocarbons are produced having a boiling point of less than about 371° C. (about 700° F.). The fuel mode refined hydrocarbons are typically provided to a fractionation zone to separate the fuel mode refined hydrocarbons into various products, including but not limited to a middle distillate fuel oil fraction comprising distillate fuels. The fuel mode refined hydrocarbons comprising at least about 80 weight percent (wt %), distillate fuels, based on the total weight of the fuel mode refined hydrocarbons.

Accordingly, suitable noble metal catalysts on acidic supports for the hydrofinishing zone are those capable of catalyzing both saturation of unsaturated heavy hydrocarbons, as well as cracking of heavy hydrocarbons. More specifically, the noble metal catalyst on an acidic support must be capable of catalyzing both saturation and cracking of the heavy hydrocarbons when the hydrofinishing zone is operated in fuel mode, as described above and which involves relatively higher temperatures than lube mode operation. Alternatively, the noble metal catalyst on an acidic support should catalyze saturation of the heavy hydrocarbons, with minimal cracking reactions, when the hydrofinishing zone is operated in lube mode as described in further detail below.

Suitable noble metal catalysts on acidic supports comprise a noble metal selected from the group consisting of: rhodium (Rh), palladium (Pd), silver (Ag), iridium (Ir), platinum (Pt), and combinations thereof. For example, in some embodiments, the noble metal catalyst comprises at least one noble metal selected from the group consisting of: rhodium (Rh), palladium (Pd), platinum (Pt), and combinations thereof. Suitable acidic supports for the noble metal catalyst include, for example, a support structure comprising alumina, amorphous silica alumina (ASA), as well as various metal oxides or zeolites such as ultrastable Y and Beta zeolite material. The noble metal catalysts may further comprise additional components such as are known now or in the future to persons of ordinary skill in the relevant art for enhancing or modifying the performance or activity of the noble metal catalysts.

Operating the refining system 10 in fuel mode may continue for a period of time such as, for example, at least about one week, or more, as necessary to produce the desired quantity of middle distillate fuels. The distillate fuels (fuel oils) produced by the fuel mode of operation of this method comprise primarily $C_8$-$C_{23}$ hydrocarbons, for example without limitation, primarily $C_{10}$-$C_{22}$ hydrocarbons, primarily $C_{12}$-$C_{22}$ hydrocarbons, or even primarily $C_{15}$-$C_{22}$ hydrocarbons. Furthermore, the distillate fuels produced by this method may have a boiling point of from about 149 to about 371° C. (about 300 to about 700° F.), such as without limitation, from about 249 to about 371° C. (about 480 to about 700° F.), or from about 288 to about 371° C. (about 550 to about 700° F.), or even from about 149 to about 288° C. (about 300 to about 550° F.).

When the refining system is operated in fuel mode, at least about 80 wt % of the total weight of fuel mode refined hydrocarbons provided to the fractionation zone are distillate fuels and, therefore, at least about 80 wt % of the total weight of fuel mode refined hydrocarbons exit the fractionation zone as the distillate fuels. For example, in some embodiments, at least about 85 wt %, or at least about 90 wt %, or even at least about 95 wt %, of the total weight of fuel mode refined hydrocarbons are distillate fuels. Furthermore, it is noted that the remaining fuel mode refined hydrocarbons exiting the fractionation zone generally comprise unconverted oil (UCO) in the lube oil hydrocarbon range that are less likely to be suitable for use as lube basestocks. Additionally, or alternatively, such residual UCO exiting from the fractionation zone during operation in fuel mode may be suitable for use as feedstock for other refining processes such as, for example without limitation, fluid catalytic cracking processes, and ethylene cracking processes.

The lube mode of operating the refining system, on the other hand, favors production of lube basestocks and comprises contacting the heavy hydrocarbons with the hydroisomerization catalyst in the dewaxing zone under the same temperature and pressure conditions as described hereinabove for fuel mode operation. Accordingly, hydroisomerization of the heavy hydrocarbons is catalyzed in the dewaxing zone, with some hydrocracking of the heavy hydrocarbons possible, and dewaxed heavy hydrocarbons are produced. In the lube mode of operation, it is preferred to select operating conditions for the dewaxing zone, from within the above-stated temperature and pressure ranges, which will minimize cracking side reactions.

The lube mode of operating the refining system further comprises contacting the dewaxed heavy hydrocarbons from the dewaxing zone with the noble metal catalyst in the hydrofinishing zone at temperatures of from about 200 to about 288° C. (about 392 to about 550° F.) and a pressure of from about 3.45 to about 17.24 MPa. For example, the temperatures in the hydrofinishing zone during fuel mode operation may be, without limitation, from about from about 200 to about 280° C., or from about 200 to about 260° C. Likewise, the pressures in the hydrofinishing zone during fuel mode operation may be, for example without limitation, from about 3.45 to about 17.24 MPa, from about 3.45 to about 13.8 MPa, or even from about 3.45 to about 10.3 MPa. It is noted that during lube mode operation, the hydrofinishing zone is operated at relatively lower temperatures than during fuel mode operation, which serves to discourage cracking of the heavy hydrocarbons. Under these lube mode operating conditions, saturation of unsaturated hydrocarbons is maximized and lube mode refined hydrocarbons are preferentially produced. The lube mode refined hydrocarbons comprise at least about 70 wt % lube oils, based on the total weight of the lube mode refined hydrocarbons.

The lube mode refined hydrocarbons are typically provided to a fractionation zone to separate the fuel mode refined hydrocarbons into various products, including but not limited to a lube oil fraction comprising lube basestocks and having a boiling point of at least about 371° C. (about 700° F.). Furthermore, when the refining system is operated in lube mode, at least about 70% wt) of the total weight of lube mode refined hydrocarbons provided to the fractionation zone are lube oil hydrocarbons and, therefore, at least about 70 wt % of the total weight of lube mode refined hydrocarbons exit the fractionation zone as the lube oil fraction comprising lube basestocks. For example, in some embodiments, at least about 75 wt %, or at least about 80 wt %, or at least about 85 wt %, or even at least about 90 wt %, of the total weight of lube mode refined hydrocarbons comprise the lube oil fraction.

Lube basestocks are commonly used for the production of lubricants, such as lubricating oils for automotives, industrial lubricants and lubricating greases. Finished lubricant products consist of two general components, lubricating basestock and additives. Lube basestock is the major constituent of such finished lubricant products and contributes significantly to its properties. In general, a few lube basestocks are used to manufacture a wide variety of finished lubricant products by varying the mixtures of individual lube basestocks and individual additives.

According to the American Petroleum Institute (API) classifications, basestocks are categorized in five groups based on their saturated hydrocarbon content, sulfur level, and viscosity index (Table 1). Lube base stocks are typically produced in large scale from non-renewable petroleum sources. Group I, II, and III basestocks are all derived from crude oil via extensive processing, such as solvent extraction, hydrotreating, hydrocracking, solvent or catalytic dewaxing, and hydroisomerization. Group III basestocks can also be produced from synthetic hydrocarbon liquids obtained from natural gas, coal or other fossil resources. Group IV basestocks, the polyalphaolefins (PAO), are produced by oligomerization of alpha olefins, such as 1-decene, and Group V basestocks include everything that does not belong to Groups I-IV, such as naphthenics, polyalkylene glycols (PAG), and esters.

TABLE 1

| API Class | Group I | Group II | Group III | Group IV | Group V |
|---|---|---|---|---|---|
| % Saturates | <90 | ≥90 | ≥90 | Polyalpha-olefins (PAO) | All others not belonging to Groups I-IV |
| % S | >0.03 | ≤0.03 | ≤0.03 | | |
| Viscosity Index (VI) | 80-120 | 80-120 | ≥120 | | |

The high quality lube basestocks produced by the lube mode of operation of the method described herein are API Group II and III lube basestocks. As noted above in Table 1, API Group II basestocks have a saturates content of 90 wt % or greater, a sulfur content of not more than 0.03 wt % and a viscosity index (VI) greater than 80 but less than 120. API Group III basestocks are the same as Group II basestocks, except that the VI is at least 120. The methods described hereinbelow are typically suitable for production of Group II and Group III basestocks from heavy hydrocarbons such as those described above. API Group III lube basestocks are of particular interest.

By selecting a noble metal catalyst on an acidic support that is capable of catalyzing both saturation and cracking of heavy hydrocarbons, or predominantly saturation of heavy hydrocarbons, under different operating conditions (e.g., fuel mode, or lube mode), and using that noble metal catalyst in the hydrofinishing zone, both fuel oils and lube basestocks can not only be manufactured from the same heavy hydrocarbon feedstocks, but also using the same refining system with adjustments made only to operating conditions (i.e., temperature and pressure of the hydrofinishing zone). This eliminates the need for separate refining systems, or additional apparatus within the same refining system.

For example, catalyst changes are not required any more often than operating in only one or the other of the lube and fuel modes. Changing between the fuel mode and the lube mode should not require adjustments to feed rates any more than operation in only one or the other mode would require. Apparatus and processes for monitoring the refining system and its operating conditions remain substantially the same, while the necessary adjustments to the operating temperatures and pressures of the hydrofinishing zone are well within the capability of persons of ordinary skill in the relevant art using known technology and methods.

Regardless of whether the refining system is operated in fuel mode or lube mode, some embodiments of the method for processing heavy hydrocarbons also includes preheating the heavy hydrocarbons in a heating zone prior to providing them to the dewaxing zone. Preheating the heavy hydrocarbons may include use of a fired furnace, or other conventional heating apparatus capable of increasing the temperature of the heavy hydrocarbons to the desired elevated temperature.

As already mentioned, the method for processing heavy hydrocarbons may include subjecting either the lube mode refined heavy hydrocarbons, or the fuel mode refined heavy hydrocarbons, or both, to fractionation in a fractionation zone to separate the refined hydrocarbons produced by the hydrofinishing zone into different hydrocarbon products. For instance, fractionating the fuel mode refined heavy hydrocarbons forms various products including but not limited to a middle distillate fuel oil fraction comprising distillate fuels, while fractionating the lube mode refined heavy hydrocarbons forms various products including by not limited to a lube oil fraction comprising lube basestocks. Furthermore, prior to fractionation, the lube mode refined heavy hydrocarbons, or the fuel mode refined heavy hydrocarbons, or both, are typically subjected to vapor-liquid separation in a phase separation zone, to produce a liquid stream comprising refined heavy hydrocarbons which is then subjected to fractionation.

With reference now to FIG. 1, a schematic diagram is provided showing in an exemplary embodiment a refining system 10 useful for practicing the methods contemplated and described herein for alternating production of fuel oils and lube oils. More particularly, the embodiment of the refining system 10 shown in FIG. 1 includes a dewaxing zone 14 and a hydrofinishing zone 16 in fluid communication with the dewaxing zone 14. Although not specifically shown in FIG. 1, the dewaxing zone 14 contains a hydroisomerization catalyst capable of catalyzing hydroisomerization of the n-alkanes contained in the heavy hydrocarbons. The hydrofinishing zone 16 contains a noble metal catalyst on an acidic support (also not shown) capable of catalyzing saturation of unsaturated heavy hydrocarbons and cracking heavy hydrocarbons, depending on whether fuel mode or lube mode operating conditions, as described hereinabove, are used. More particularly, during fuel mode operation, it is desired that both saturation and cracking of the heavy hydrocarbons will occur in the hydrofinishing zone 16.

During lube mode operation, it is desired that saturation occur predominantly, while cracking reactions are minimized in the hydrofinishing zone 16.

As shown in FIG. 1, the refining system 10 may further comprise a phase separation zone 18 for vapor-liquid separation of the fuel mode or lube mode refined hydrocarbons which produces a liquid stream comprising fuel mode refined hydrocarbons or lube mode refined hydrocarbons, respectively. Typically, the refining system 10 also includes a fractionating zone 28 for separating the liquid stream into various products including, without limitation, a middle distillate fuel oil fraction comprising fuel oils when fuel mode operation is practiced, or a lube oil fraction comprising lube basestocks when lube mode operation is practiced.

In the embodiment shown in FIG. 1, heavy hydrocarbons, which may be derived for example from VGO, UCO, or a combination thereof, are often provided through a feed line 20 to a heating zone, such as a fired furnace 12, wherein a the heavy hydrocarbons and hydrogen are heated to desired reaction temperature. The original VGO may be hydrotreated (not shown) to remove sulfur and nitrogen in excess of the aforesaid amounts, or subjected to hydrocracking (not shown), or both, prior to or after being provided to the heating zone 12.

After being heated in the heating zone 12, the heavy hydrocarbons are provided to the dewaxing zone 14 and contacted with the hydroisomerization catalyst (not shown) at temperatures of from about 200 to about 427° C. and pressures of from about 3.45 to about 17.24 megaPascals (MPa), as described above, regardless of whether operation is in fuel mode or lube mode. Hydroisomerization of the heavy hydrocarbons occurs in the dewaxing zone 14, and dewaxed heavy hydrocarbons are produced. Although cracking of heavy hydrocarbons may also occur in the dewaxing zone 14, hydroisomerization should be the predominant reaction, with minimal cracking occurring. Suitable vessels for containing the dewaxing zone 14 include any conventional vessels capable of withstanding the foregoing operating conditions and reactions.

When operating the refining system 10 in fuel mode, the dewaxed hydrocarbons are provided to the hydrofinishing zone 16 and contacted with the noble metal catalyst on an acidic support therein at temperatures of from about hydrofinishing zone at temperatures of from about greater than 288 to about 427° C. (greater than about 550 be to about 800° F.) and a pressure of from about 3.45 to about 17.24 MPa, as described above. Under these fuel mode operating conditions, saturation of unsaturated hydrocarbons catalyzed, as well as cracking of heavy hydrocarbons, occurs in the hydrofinishing zone 16, and fuel mode refined hydrocarbons are produced. Suitable vessels for containing the hydrofinishing zone 16 include any conventional vessels capable of withstanding the foregoing operating conditions and reactions.

Furthermore, the fuel mode refined hydrocarbons are typically subjected to separation in a fractionating zone 28 which produces distillate fuels that exit via line 30. As will be recognized by persons of ordinary skill in the relevant art, while FIG. 1 shows only one exit line 30 for the distillate fuel products, the distillate fuels produced during fuel mode operation of the refining system 10 may exit from the fractionating zone 28 via more than one exit line (not shown) depending upon the particular fuel products desired (e.g., naphtha, gasoline, or diesel range hydrocarbon fuels).

It is noted that during operation of the refining system 10 in fuel mode, the step of fractionating the fuel mode-refined hydrocarbons in the fractionating zone 28 also produces an unconverted oil (UCO) fraction 32 which exits the bottom of the fractionating zone 28. In some embodiments, the method contemplated herein may further comprise recycling at least 80 wt % the UCO fraction 32 to the hydrocracking/hydrofinishing zone 16 via a recycle line 22. Where less than 100 wt % of the UCO fraction 32 is recycled, the portion not recycled exits the system via line 34, and may be suitable for use as feedstock for other refining processes such as, for example without limitation, fluid catalytic cracking processes, and ethylene cracking processes.

As shown in FIG. 1, hydrogen may be provided through a hydrogen feed line 24 to the heavy hydrocarbons fed to the heating furnace zone 12 to facilitate any of the various refining processes occurring in the hydrocracking, dewaxing and hydrofinishing zones, 14 and 16. Additionally, a hydrogen-rich stream may exit the vapor/liquid separation region 18 through vent line 26 and then be provided to any one or more of the heavy hydrocarbons fed to the dewaxing zone 14 and the hydrofinishing zone 16, to provide additional hydrogen and facilitate the refining processes occurring therein.

During lube mode operation of the system 10, the dewaxed heavy hydrocarbons are provided to the hydrofinishing zone 16 and contacted therein with the noble metal catalyst on an acidic support at temperatures of from about 200 to about 288° C. (about 392 to about 550° F.) and a pressure of from about 3.45 to about 17.24 MPa. Under these lube mode operating conditions, saturation of unsaturated hydrocarbons is maximized, cracking reactions are minimized, and lube mode refined hydrocarbons are produced. The lube mode refined hydrocarbons are fractionated after vapor/liquid separation region 18 to produce a lube oil fraction comprising lube basestocks. The lube basestocks exiting the fractionating zone 28 via lines 32 and 34 are API Group II and III lube basestocks and as such, have a saturates content of about 90 wt % or greater and a sulfur content of not more than about 0.03 wt %, based on the total weight of the lube basestocks. In some embodiments, the lube basestocks produced are API Group II lube basestocks having a viscosity index of greater than about 80 but less than about 120. In other embodiments, the lube basestocks produced are API Group III lube basestocks having a viscosity index of at least about 120.

In some embodiments of the methods and apparatus contemplated herein, the refining system may further comprise a cracking zone (not shown in FIG. 1), which may or may not include a hydrocracking catalyst. This may be advantageous, for example, where the heavy hydrocarbons comprise the heavy distillates and residuals fraction from atmospheric distillation of crude oil process (described above). In such embodiments, the method may further comprise cracking heavy hydrocarbons in the heavy distillates and residuals fraction, in the cracking zone, to produce cracked heavy hydrocarbons which may then be provided to the dewaxing zone. In such cases, unless previously subjected to a hydrotreating process, the resulting cracked heavy hydrocarbons are likely to contain sulfur and nitrogen in amounts above 100 ppm and 10 ppm, respectively. Thus, in some embodiment of the methods and apparatus described herein, the refining apparatus may further comprise a hydrotreating zone (not shown), in addition to a cracking zone (not shown) and the method may further comprise hydrotreating the heavy hydrocarbons in addition to cracking them, prior to providing them to the dewaxing zone.

While at least one exemplary embodiment has been presented in the foregoing detailed description of the method contemplated herein, it should be appreciated that a vast number of variations exist. It should also be appreciated that the exemplary embodiment or exemplary embodiments are only examples, and are not intended to limit the scope, applicability, or configuration, in any way, of the method for increasing production of middle distillates from heavy hydrocarbon feed in an FCC system. Rather, the foregoing detailed description will provide those skilled in the art with a convenient road map for implementing an exemplary embodiment of said method.

What is claimed is:

1. A method for processing heavy hydrocarbons, said method comprising the steps of:

providing a refining system comprising a dewaxing zone comprising a hydroisomerization catalyst and a hydrofinishing zone comprising a noble metal catalyst on an acidic support;

providing heavy hydrocarbons comprising up to about 100 parts per million (ppm) of sulfur and up to about 10 ppm of nitrogen to the refining system;

operating the refining system, for a first period of time, in either a fuel mode or a lube mode while contacting the heavy hydrocarbons with the hydroisomerization catalyst in the dewaxing zone and the noble metal catalyst on an acidic support in the hydrofinishing zone, wherein operating the refining system in the fuel mode comprises a hydrofinishing zone temperature of from greater than about 288 to 427° C. (greater than about 550 to about 800° F.) and operating the refining system in the lube mode comprises a hydrofinishing zone temperature of from about 200 to 288° C. (about 392 to about 550° F.);

operating the refining system, for a second period of time, in the other of the fuel mode or lube mode by adjusting the hydrofinishing zone temperature in either the fuel mode or the lube mode while contacting the heavy hydrocarbons with the hydroisomerization catalyst in the dewaxing zone and the noble metal catalyst on an acidic support in the hydrofinishing zone; and producing a middle distillate fuel oil fraction comprising distillate fuels when the refining system is operating in the fuel mode and producing a lube oil fraction comprising lube basestocks when the refining system is operating in the lube mode.

2. The method of claim 1, wherein during providing the heavy hydrocarbons to the refining system, at least a portion of the heavy hydrocarbons are derived from vacuum gas oil (VGO), unconverted oil (UCO), or a combination thereof.

3. The method of claim 1, wherein providing the refining system comprises providing a hydrofinishing zone having a noble metal catalyst on an acidic support capable of catalyzing both saturation of unsaturated heavy hydrocarbons, as well as cracking of heavy hydrocarbons.

4. The method of claim 1, wherein providing the refining system comprises providing a hydrofinishing zone having a noble metal catalyst on an acidic support, wherein the noble metal is selected from the group consisting of: rhodium (Rh), palladium (Pd), platinum (Pt), and combinations thereof, and the acidic support comprises alumina, amorphous silica alumina (ASA), a metal oxide, an ultrastable Y zeolite, a Beta zeolite, or combinations thereof.

5. The method of claim 1, wherein operating the refining system in fuel mode comprises:

contacting the heavy hydrocarbons with the hydroisomerization catalyst in the dewaxing zone of the refining system at temperatures of from about 230 to about 427° C. and pressures of from about 3.45 to about 17.24 MPa, whereby dewaxed cracked hydrocarbons are produced;

contacting the dewaxed cracked hydrocarbons with the noble metal catalyst in the hydrofinishing zone of the refining system, the hydrofinishing zone being in fluid contact with the dewaxing zone, at temperatures of from greater than about 288 to about 427° C. (greater than about 550 to about 800° F.) and a pressure of from about 3.45 to about 17.24 MPa, whereby fuel mode refined hydrocarbons are produced; and fractionating the fuel mode refined hydrocarbons in a fractionation region of the refining system, the fractionating region being in fluid communication with the hydrofinishing zone, to produce a middle distillate fuel oil fraction comprising distillate fuels;

and wherein operating the refining system in lube mode comprises:

contacting the heavy hydrocarbons with the hydroisomerization catalyst in the dewaxing zone of the refining system at temperatures of from about 230 to about 427° C. and pressures of from about 3.45 to about 17.24 megaPascals (MPa), whereby dewaxed heavy hydrocarbons are produced;

contacting the dewaxed heavy hydrocarbons with the noble metal catalyst in the hydrofinishing zone of the refining system at temperatures of from about 200 to about 288° C. (about 392 to about 550° F.) and a pressure of from about 3.45 to about 17.24 MPa, whereby lube mode refined hydrocarbons are produced; and fractionating the lube mode refined hydrocarbons in the fractionation region of the refining system to produce a lube oil fraction comprising lube basestocks.

6. The method of claim 5, wherein fractionating the fuel mode refined hydrocarbons produces distillate fuels comprises primarily $C_9$-$C_{23}$ hydrocarbons and have a boiling point of about 149 to about 371° C.

7. The method of claim 5, wherein, during operation of the refining system in fuel mode, the step of fractionating the fuel mode refined hydrocarbons comprises producing an unconverted oil (UCO) fraction; said method further comprising recycling at least 80 weight percent of the UCO fraction to the hydrofinishing zone.

8. The method of claim 5, wherein fractionating the lube mode refined hydrocarbons comprises producing lube basestocks having a saturates content of about 90 wt % or greater and a sulfur content of not more than about 0.03 wt %, based on the total weight of the lube basestocks.

9. The method of claim 8, wherein fractionating the lube mode refined hydrocarbons comprises producing lube basestocks further having a viscosity index of greater than about 80 but less than about 120.

10. The method of claim 8, wherein fractionating the lube mode refined hydrocarbons comprises producing a lube basestocks further having a viscosity index of at least about 120.

11. The method of claim 5, wherein operation of the refining system in fuel mode produces fuel mode refined hydrocarbons comprising at least about 80 weight percent (wt %) distillate fuels, based on the total weight of the fuel mode refined hydrocarbons.

12. The method of claim 5, wherein operation of the refining system in lube mode produces lube mode refined hydrocarbons comprising at least about 70 weight percent (wt %) lube oils, based on the total weight of the lube mode refined hydrocarbons.

13. The method of claim 5, wherein, during operation of the refining system, the step of fractionating also produces a hydrogen-rich stream and said method further comprises recycling the hydrogen-rich stream to the dewaxing zone, the hydrofinishing zone, or both.

14. The method of claim 5, wherein the step of providing heavy hydrocarbons comprises cracking heavy hydrocarbons in a cracking zone after contacting the heavy hydrocarbons with the hydroisomerization catalyst in the dewaxing zone to produce cracked heavy hydrocarbons.

15. The method of claim 14, wherein, during operation of the refining system, the step of fractionating comprises producing a hydrogen-rich stream and said method further comprises recycling the hydrogen-rich stream to one or more of the cracking zone, the dewaxing zone, and the hydrofinishing zone.

16. The method of claim 14, wherein, during operation of the refining system in fuel mode, the step of fractionating the fuel mode refined hydrocarbons comprises producing a UCO fraction and said method further comprises recycling the UCO fraction to the cracking zone.

17. A method for processing heavy hydrocarbons, said method comprising the steps of:

providing a refining system comprising a dewaxing zone comprising a hydroisomerization catalyst and a hydrofinishing zone comprising a noble metal catalyst on an acidic support;

providing heavy hydrocarbons comprising up to about 100 parts per million (ppm) of sulfur and up to about 10 ppm of nitrogen to the refining system;

operating the refining system, for a first period of time, in either a fuel mode or a lube mode while contacting the heavy hydrocarbons with the hydroisomerization catalyst in the dewaxing zone and the noble metal catalyst on an acidic support in the hydrofinishing zone, wherein operating the refining system in the fuel mode comprises a hydrofinishing zone temperature of from greater than about 288 to 427° C. (greater than about 550 to about 800° F.) and operating the refining system in the lube mode comprises a hydrofinishing zone temperature of from about 200 to 288° C. (about 392 to about 550° F.);

operating the refining system, for a second period of time, in the other of the fuel mode or lube mode by adjusting the hydrofinishing zone temperature in either the fuel mode or the lube mode while contacting the heavy hydrocarbons with the hydroisomerization catalyst in the dewaxing zone and noble metal catalyst on an acidic support in the hydrofinishing zone; and producing a middle distillate fuel oil fraction comprising distillate fuels when the refining system is operating in the fuel mode and producing a lube oil fraction comprising lube basestocks when the refining system is operating in the lube mode;

wherein operating the refining system in fuel mode comprises:

contacting the heavy hydrocarbons with the hydroisomerization catalyst in the dewaxing zone of the refining system at temperatures of from about 230 to about 427° C. and pressures of from about 3.45 to about 17.24 MPa, whereby dewaxed hydrocarbons are produced;

contacting the dewaxed hydrocarbons with the noble metal catalyst on an acidic support in the hydrofinishing zone of the refining system, the hydrofinishing zone being in fluid contact with the dewaxing zone, at the hydrofinishing zone temperatures of from about greater than 288 to about 427° C. (greater than about 550 to about 800° F.) and a pressure of from about 3.45 to about 17.24 MPa, whereby fuel mode refined hydrocarbons are produced; and fractionating the fuel mode refined hydrocarbons in a fractionation region of the refining system, the fractionating region being in fluid communication with the hydrofinishing zone, to produce a middle distillate fuel oil fraction comprising distillate fuels, wherein said step of fractionating the fuel mode refined hydrocarbons comprises producing an unconverted oil (UCO) fraction and recycling a portion of the UCO fraction to the dewaxing zone;

and wherein operating the refining system in lube mode comprises:

contacting the heavy hydrocarbons with the hydroisomerization catalyst in the dewaxing zone of the refining system at temperatures of from about 230 to about 427° C. and pressures of from about 3.45 to about 17.24 MPa, whereby dewaxed heavy hydrocarbons are produced;

contacting the dewaxed heavy hydrocarbons with the noble metal catalyst on an acidic support in the hydrofinishing zone of the refining system at the hydrofinishing zone temperatures of from about 200 to about 288° C. (about 392 to about 550° F.) and a pressure of from about 3.45 to about 17.24 MPa, whereby lube mode refined hydrocarbons are produced; and fractionating the lube mode refined hydrocarbons in the fractionation region of the refining system to produce a lube oil fraction comprising lube basestocks.

18. The method of claim 17, wherein operation of the refining system in fuel mode produces fuel mode refined hydrocarbons comprising at least about 80 weight percent (wt %) distillate fuels, based on the total weight of the fuel mode refined hydrocarbons, and wherein operation of the refining system in lube mode produces lube mode refined hydrocarbons comprising at least about 70 wt % lube oils, based on the total weight of the lube mode refined hydrocarbons.

* * * * *